United States Patent [19]

Taylor, deceased et al.

[11] 4,157,830

[45] Jun. 12, 1979

[54] WOOD TYPE GOLF CLUB

[76] Inventors: David L. Taylor, deceased, late of Carmel Valley, Calif.; by Dale W. W. Taylor, executor, 380 W. Carmel Valley Rd., Carmel Valley, Calif. 93924

[21] Appl. No.: 778,712

[22] Filed: Jan. 10, 1977

[51] Int. Cl.[2] ..... A63B 53/04

[52] U.S. Cl. ..... 273/167 G; 273/80 C; 273/164

[58] Field of Search ..... 273/77 R, 80 C, 164, 273/165, 81.3, 167-175, 183 D, 193 R, 194 R; D34/5 GS, 5 GH, 5 GC

[56] References Cited

U.S. PATENT DOCUMENTS

| | | | |
|---|---|---|---|
| D. 209,149 | 11/1967 | Sowers | 273/167 G X |
| 1,703,199 | 2/1929 | McClure | 273/80 C X |
| 2,003,951 | 6/1935 | Pepin | 273/164 |
| 2,088,095 | 7/1937 | Sargent et al. | 273/80 C |
| 2,842,369 | 7/1958 | East | 273/164 |
| 2,859,972 | 11/1958 | Reach | 273/164 |
| 3,035,839 | 5/1962 | Coglianese | 273/164 |
| 3,166,320 | 1/1965 | Onions | 273/80 C |
| 3,595,582 | 7/1971 | Chapman | 273/164 X |
| 3,955,819 | 5/1976 | Yokich | 273/164 |
| 3,980,301 | 9/1976 | Smith | 273/80 C X |

FOREIGN PATENT DOCUMENTS

| | | | |
|---|---|---|---|
| 238646 | 10/1960 | Australia | 273/80 C |
| 899562 | 6/1962 | United Kingdom | 273/80 C |

*Primary Examiner*—Richard J. Apley
*Attorney, Agent, or Firm*—Flehr, Hohbach, Test, Albritton & Herbert

[57] ABSTRACT

A wood type golf club where the acme of proper address (and contact) and alignment of the club with the target are achieved by angling the hosel and/or shaft forward some 3° to 6° from the normal parallel line up between the shaft and face of the conventional wood club, and the use of a plurality of parallel spaced stripes in a substantial area on the top surface of the head of the wood club which stripes are perpendicular to the plane of the striking face and aligned parallel with the line to the target. If the alignment is properly made at the time of address the shaft of the club will be in position for proper straight left arm and shaft extension for proper impact position toward the target.

3 Claims, 4 Drawing Figures

WOOD TYPE GOLF CLUB

BACKGROUND OF INVENTION

Wood clubs have long been the implement used for distance in the game of golf. Yet wood clubs are difficult to use. The average wood club over the years in its form and design has no straight lines either perpendicular to, or in the intended line of flight of the golf ball toward the target. It has nothing therefore with which to aim the striking face at the target at the time of addressing the ball. With the iron clubs the bottom line of the face is straight, or nearly so and in most instances is visible when the ball is addressed. In a wood club the bottom line of the face is curvilinear and because of the roll or curvature of the striking face both from top and bottom and horizontally it is not possible to use the bottom line of the face for aiming in the direction of the target. The bottom line is not visible as the ball is addressed. Over the years there has been no substantial change in the design and structural features of a wood club head and so the golfer has had nothing to aid him in determining whether or not he is in fact aiming at his intended target when making a shot.

It is a well accepted, and a long taught golf theory that the golf shaft and the left arm should be in one line or in-line at the address for the stroke and at impact. The fine golf analyst and teacher Jim Roberts in *Golf World* for Mar. 5, 1976 describes the swing of Hale Erwin and his own experience as follows:

"[A proper setup] sets the stage for the entire swing and can't be stressed too strongly."

"Often pupils have shown me their address and too many have the hands far in front of the ball. Hale is a smooth, one-line to the ball, arms, hands and club. By placing the hands ahead you are inviting the dreaded pickup of the club head at the very start of the backstroke."

Leo Kosten in *Golf World* for Apr. 16, 1976 uses the swing of John Mahaffey on the drive as an example as follows:

"The rest of his setup is excellent. John positions the ball well forward in his stance, allowing his left arm and the club to form a straight line. His head position is in back of the ball and his knees have the right degree of flex."

These are only samples of how professionals on the tour and professionals in the teaching area view the importance of proper address. Not having anything to aid in the alignment of a wood club head, the teaching emphasis has been solely on the proper address which should be the straight in-line position at the time of impact. In spite of this observation there are still no aiming aids at the time of the address to the golf ball with the wood clubs, which would give direction to the proper address, and even with the proper setup as presently taught, the wood club face will not be perpendicular to the line to the target at the point or time of impact.

STATE OF THE ART

Up to this point there have been no aiming aids but there have been some changes in wood clubs recently.

In *Golf Digest* for July 1976 at page 8 the new "Iron/-Woods" were introduced for the first time. The effort here was to give the same accuracy to a wood shot as that of an iron. In this connection it is shown that the hosel of the wood club is offset as part of the head so that the impact point of the ball in relation to the center line of the shaft and the player's hands are exactly the same for all clubs from the driver to the putter. By offsetting the hosel, the position of the shaft is farther forward but still in a plane parallel to the position of the conventional shaft. Such a change has produced a result in woods which was heretofore accomplished only by the design of the irons and improves the setup somewhat, but still no means or aid is given the golfer so far as alignment with the target at the time of setup. It will be observed that even this change does not accomplish the result of having the club face perpendicular to the line to the target at the time of impact even with the proper setup.

It has now been learned that there are two major dimensions of the force vectors in making a golf shot. These are magnitude and direction. The magnitude of course is the force applied in striking a golf ball and is solely controlled by the golfer. Direction is also in the control of the golfer but it is difficult to achieve and requires the proper address to the ball which should be the same position at the time of impact. As before indicated this, according to the best instruction, proper setup requires having the left arm, hand and club in a straight line or in-line directly down to the head of the club.

It has been seen that best results of a golf shot are to be had when the golf swing produces an in-line position (the same as that for address) at the time of impact.

Therefore, both at impact and at address, this in-line position must be achieved at the same time as the clubface is perpendicular to the intended line of flight.

However, since the left shoulder is forward of the ball, the plane of the face must not be parallel to the line of the left arm and shaft. In fact, the angle between the plane of the face and the line of the arm and shaft must be the same as the angle formed by the line of the arm and shaft and a line originating in the left shoulder and intersecting the intended line of flight at right angles.

Furthermore, these characteristics are necessary but not sufficient for proper address, and therefore impact, position. A wood of this construction can still be used to address, and therefore impact, the ball improperly if the face is not set perpendicular to the intended line of flight. This happens because the golfer has no alignment aid and cannot easily address the ball correctly. The elimination of these explainable physical caused for missed shots of course, is highly desirable. Every missed shot not only raises the score of the golfer but is more than likely to produce some sort of other penalty. Thus it is of great importance to have some means to aid the golfer in determining not only an appropriate address but that this address will also accomplish the other requirement of direction.

The present invention combines and solves the two physical requirements for improving wood club shots, i.e. proper address and direction. Assuming a proper address, the face of the wood club would not be at right angles to the line of flight to the target. This is because the human anatomy brings the left shoulder well ahead of the ball when the proper address is met. Accordingly it has been discovered that by directing the hosel angularity 3° to 6° inclusive from the normal parallel position of the shaft and club face of the conventional wood golf club, the address becomes one of natural ease without concentration on the several matters necessarily involved. In this position the proper direction toward the target, direction on alignment would be most difficult without some tangible aid. This is provided by the stripes on the top surface of the club head. What is new, wholly unexpected and of substantial importance is that this result of proper address and alignment with the target is achieved only by the combination of the angularity of the hosel and shaft and the visible stripes on the top surface of the club head.

Further objects are to provide a construction of maximum simplicity, economy and ease of assembly and disassembly also such further objects, advantages and capabilities as will fully appear and as are inherently possessed by the device and invention described herein.

The invention further resides in the combination, construction and arrangement of parts illustrated in the accompanying drawings, and while there is shown therein a preferred embodiment thereof, it is to be understood that the same is illustrative of o the invention and that the invention is capable of modification and change and comprehends other details of construction without departing from the spirit thereof or the scope of the appended claims.

DESCRIPTION OF THE PREFERRED EMBODIMENT

Figure 1:
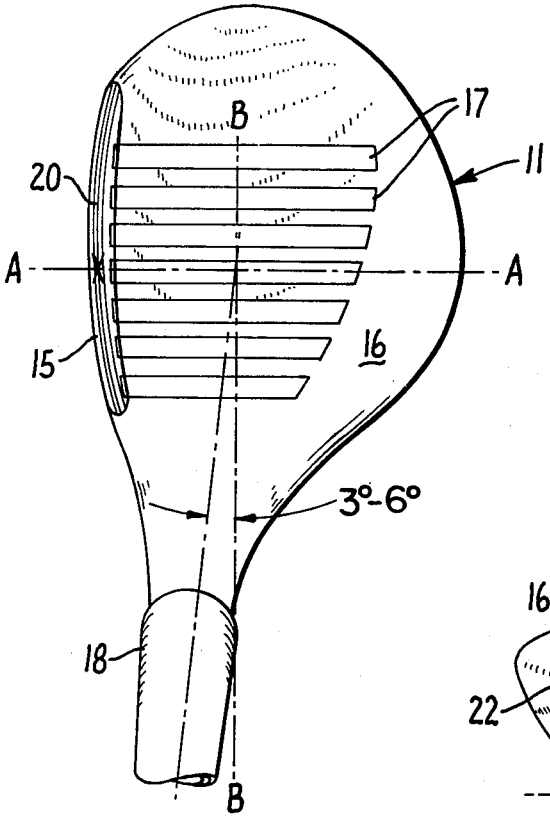
FIG. 1 is the top plan view of the wood club head with the shaft in fragmentary form, shown mounted therein in the required angularity, and with the conventional parallel shafting shown in phantom.
Figure 3:
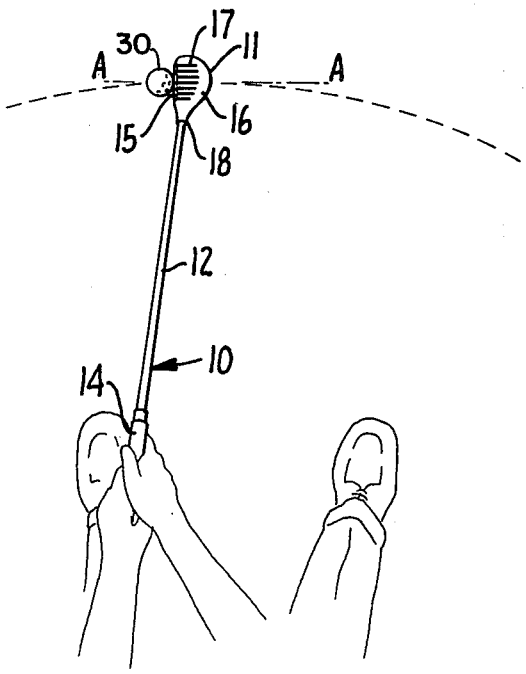
FIG. 3 is a top plan view of the proper address and alignment to the target using the wood club described herein.

Referring now more particularly to the drawing in which like reference numerals indicate like parts in the several views and with particular reference to FIGS. 1 and 3 there is shown in FIG. 3 a complete wood club 10 described herein.

Under the rules of the USGA there is very little which can be done to the shape or form of a wood club, especially when it concerns the head. The head is designated 11 and this head is secured to its normal hosel extension 18 by shaft 12 including the conventional grip 14. The head has a striking face 15, a top surface 16 in which there are a series of spaced parallel stripes 17, and a hosel 18, which forms the connection between the head 11 and the shaft 12.

Figure 2:
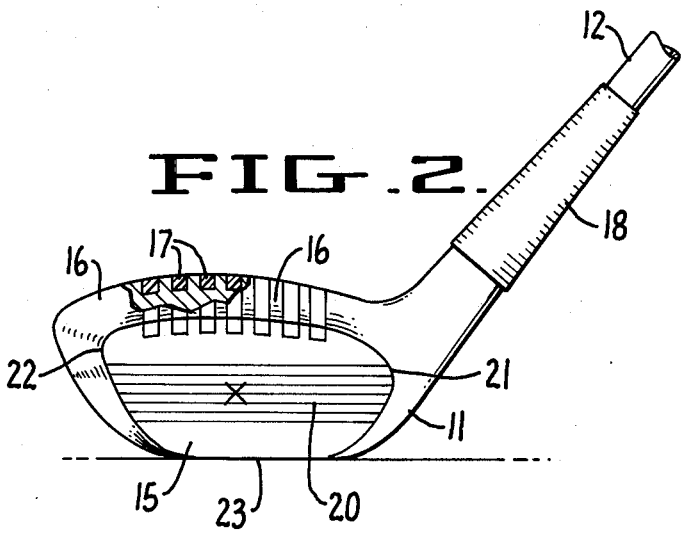
FIG. 2 is the front elevation of the club head and shaft fragment shown in FIG. 1.

As will be observed from FIG. 2 the striking face 15 is represented by the free form area 20. This area is curvilinear in that it is rounded from the heel portion 21 to the toe portion 22 and is rounded from the sole plate 23 which rests against the ground surface to the top portion 16. It will be observed that this form does not provide any flat surface over the entire area of the striking face 15 and would not in itself provide any aid for directional indication. The "sweet spot" X (shown in FIG. 2) or the ideal spot for striking a golf ball with the club 10 is where the line A—A representing the force vector intersects a plane of the face 15. Line A—A is at right angles to the line B—B which represents the line parallel to the said plane of the face 15 which conventionally would be the parallel in line plane of the shaft. Where line B—B intersects line A—A is the center of mass for the head. Due to the curvilinear nature of the striking face 15 of a wood club, the sweet spot is extended to the left and right of X. Thus if the ball is struck in the area toward the toe portion 22 for a short distance from the sweet spot X the ball's flight to the target will not be influenced to any great extent. The same would be true if the ball was struck in a similar area toward the heel portion 21.

The hosel for connecting the head 11 with the shaft 12 is directed forwardly at an angle of 3° to 6° inclusive from the line B—B which normally would pass up through and become the center line of the shaft 12. The consequences of and purposes of which will be discussed later.

On the top surface 16 of the wood club there are a plurality of spaced stripes 17 which are uniformly spaced from each other and cover a substantial portion of the top surface 16 of the club head 11. The stripes 17 are parallel with the line A—A and extend toward the toe portion 22 in one direction and the heel portion 21 in the other direction, for a distance representing slightly more than the safe areas on the face 15 for striking the ball on line to the target in a stroke. The stripes 17 as shown in FIG. 2 extend downward from the top surface 16 into the striking face area 20, so that they may not only be observed at the time of address but actually show the golfer the position of the head with respect to the face. The extension of the stripes into the face are smoothed and made integral with the face. The purpose of the stripes 17 is to line them up parallel with the desired path for the flight of the golf ball. It has recently been discovered that such plurality of stripes provides better alignment for the correct flight of the golf ball to the target than any other means yet devised. It is preferred that the stripes be flush with the surface 16 of the club head 11 and easily distinguished from the finish of the club head 16 either by means of inlay or other coloration and that they contiguously extend below the top surface 16 into the striking face 15 as a further aid in alignment.

As viewed in FIG. 3 which shows the proper address with the wood club 10, the golf ball 30 is forward of the center line between the feet of the golfer. When the head 11 is lined up so that the line A—A and the stripes 17 are parallel, the shaft 10 will automatically be directed in a straight line with the left hand and arm of the golfer. Thus a proper address (and impact) are achieved.

Figure 4:
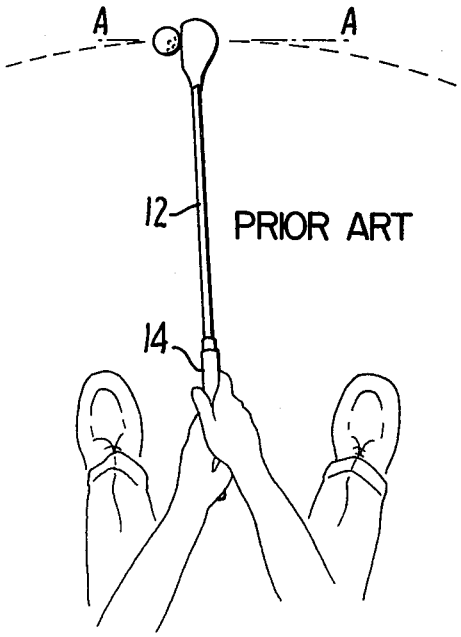
FIG. 4 shows the improper address with the standard or conventionally shafted wood club.

By reference to FIG. 4 it is seen that if the face of a conventional wood club is aligned with the line A—A which is the target line, the shaft is not directed in line with the golfer's straight left arm. It is virtually impossible for a golfer to line up the face of a conventional wood club and at the same time achieve a proper setup.

The angularity of the shaft 10 forward accomodates the human form, since the left shoulder is forward of the ball 30, and forces the golfer upon lining up the head, into the proper setup for the swing and impact.

OPERATION

In the use of the wood golf club disclosed herein it is well to keep in mind that it was produced in order to improve the game of the average golfer and give him less "do's" and "don'ts" to think of before each shot.

Also it is intended for the professional as well, for the club provides proper address and direction to the target which were not heretofore available.

The proper address is shown in FIG. 3. A poor address will always result in a missed shot. The club shown herein forces the golfer into the proper in-line position of address by the angle at which the head is bored to accept the shaft firmed by the hosel. The club will discourage any improper address and will gradually force the golfer into the desired position of arm, shaft alignment for address. However this alone does not solve the problem as the flight of the golf ball must have some directional aid. The stripes on the head are arranged to be parallel to the line of flight to the target. The use of a plurality of spaced stripes 17 makes it unnecessary to concentrate on a single line and thus become hypnotized without accomplishing the desired result. Parallel lines are more accurate than a single line or even a transverse line, for appropriate directional alignment. It has been discovered that it is easier to align the parallel lines with the intended flight than by any other method known. Thus the proper address now achieved by the combination of elements of this club, resulting from proper alignment for on target accuracy.

The use of the parallel spaced stripes on the top surface of the club head brings about an unexpected quality which is the result of eye image retention. The golfer concentrates on the parallel lines which are alternate in contrastic toning. As the head of the golfer is kept still during the entire stroke the golfer is able to see, through this phenomenen of eye image retention, the exact line of his swing. This is an unexpected benefit of the combination and enables the golfer to follow his swing without conscious effort and check whether or not he is swinging properly. Such a benefit is not easily dismissed as it saves hours of practice.

"The word 'stripes' as used in this invention means an indicator of substantial width as contrasted with a line or narrow groove."

"Also it will be noted that conventional wood golf clubs have a striking face which may be substantially vertical or angled rearwardly, as in the case of Numbers 2, 3, 4 and 5 woods. Also the striking face may be curved longitudinally from toe to heel. Both of these conventional configurations are shown in FIG. 1."

"When used herein the term 'vertical plane of the striking face' is the vertical plane which is at right angles to the line A—A of FIG. 1, and parallel to the vertical plane represented by the line B—B, also of FIG. 1."

I claim:

1. A distance wood type golf club having a head, a relatively large flat top surface, a striking face, a hosel, and a conventional shaft, said hosel for mounting said shaft being angled from 3° to 6° forward of a vertical plane parallel to the vertical plane of the striking face, making the axis of the shaft an extension of the lead arm, left arm of a right-handed player, in the address position, and said head having a plurality of uniform parallel stripes equally spaced over a substantial portion of its top surface, said stripes being alternately toned, at right angles with respect to the vertical plane of the striking face and extending thereto in a substantially horizontal plane.

2. The golf club of claim 1 wherein the said stripes on the top surface of the head are in alternate contrasting hues, and extend continuously downward for a short but readily visible distance from said top surface on said striking face.

3. A distance wood type golf club having a head, and a shaft, said head having shaft receiving means for positioning said shaft at an angle of from 3° to 6° forward of the vertical plane at right angles to the intended line of flight at the time of impact with a golf ball, making the axis of the shaft an extension of the lead arm, left arm of a right-handed player, in the address position, and wherein the said stripes are uniform, alternately of contrasting colors, are parallel to the intended line of flight and extend from the face over a substantial area of the top surface of said head and for a short but readily visible distance from the top downwardly on the striking face.

* * * * *